United States Patent [19]

Thievessen

[11] Patent Number: 4,635,872

[45] Date of Patent: Jan. 13, 1987

[54] DEVICE FOR TENSIONING CORE TUBES

[75] Inventor: Karl Thievessen, Grevenbroich, Fed. Rep. of Germany

[73] Assignee: Jagenberg AG, Dusseldorf, Fed. Rep. of Germany

[21] Appl. No.: 638,818

[22] Filed: Aug. 8, 1984

[30] Foreign Application Priority Data

Aug. 13, 1983 [DE] Fed. Rep. of Germany ..... 3329330

[51] Int. Cl.[4] ..... B65H 16/04

[52] U.S. Cl. ..... 242/72 R; 242/68.3

[58] Field of Search ..... 242/68.3, 72 R, 46.2, 242/46.21, 46.3, 46.4, 46.7, 46.8; 279/2 R; 269/48.1, 48.3

[56] References Cited

U.S. PATENT DOCUMENTS

| | | | |
|---|---|---|---|
| 2,196,489 | 4/1940 | Bennett | 279/2 R |
| 2,219,124 | 10/1940 | Baudy | 279/2 R |
| 2,487,723 | 11/1949 | Nordstrom | 279/2 R |
| 2,908,452 | 10/1959 | Jacobsen | 242/72 R |
| 3,006,565 | 10/1961 | Pelletier | 242/72 R |
| 3,963,250 | 6/1976 | Flagg | 269/48.1 |

FOREIGN PATENT DOCUMENTS

| | | | |
|---|---|---|---|
| 630628 | 6/1936 | Fed. Rep. of Germany | 279/2 R |
| 917978 | 2/1963 | United Kingdom . | |

*Primary Examiner*—Billy S. Taylor

*Attorney, Agent, or Firm*—Sprung Horn Kramer & Woods

[57] ABSTRACT

A device for tensioning core tubes, especially core tubes for webs of paper or similar materials, consists of several tensioning segments in the shape of arcs of a hollow cylinder. The segments can be displaced radially inside a cage and are distributed around an arbor. Supports are positioned between the arbor and the tensioning segments in circumferential grooves on the surface of the arbor. The cross section of the arbor is an equilateral polygon in the vicinity of the grooves. The side of each support that faces a tensioning segment is spherical and is inserted into a corresponding hemispherical depression in the inner surface of the tensioning segment. The side of each support that faces the arbor has a contact surface that matches the cross-section of the floor of the groove.

3 Claims, 4 Drawing Figures

DEVICE FOR TENSIONING CORE TUBES

BACKGROUND OF THE INVENTION

The present invention relates to a device for tensioning core tubes, especially core tubes for webs of paper or similar materials, and consists of several tensioning segments in the shape of arcs of a hollow cylinder that can be displaced radially inside a cage and that are distributed around an arbor, with supports positioned between the arbor and the tensioning segments in circumferential grooves on the surface of the arbor, whereby the cross section of the arbor is an equilateral polygon in the vicinity of the grooves.

Tensioning devices of this type are known, from British Patent No. 917 978 for instance. The supports in the known tensioning devices are cylindrical rollers. When a rotary motion is exerted on the arbor, the cylindrical rollers roll both against the floor of the circumferential grooves in the arbor and against the tubular interior surface of the tensioning segments, forcing the segments radially outward into the tensioning position or inward back into the initial position.

One drawback of the known tensioning device is a high level of wear that results from powerful stress on the arbor, tensioning segments, and cylindrical supports.

SUMMARY OF THE INVENTION

The object of the present invention is to improve a tensioning device of the aforesaid generic type in such a way as to decrease the wear on the parts that move in relation to one another.

This object is attained in accordance with the invention in a device for tensioning core tubes of the aforesaid generic type in that the side of each support that faces a tensioning segment is spherical and is inserted into a corresponding hemispherical depression in the inner surface of the tensioning segment and the side of each support that faces the arbor has a contact surface that matches the cross-section of the floor of the groove.

The shape of the tensioning segments in accordance with the invention results in extensive contact between the supports and the tensioning segments and between the supports and the arbor. The parts that move against one another—the tensioning segments, supports, and arbor—do not, accordingly, contact each other along a line as in the known tensioning device, but over an area, so that the pressure per unit of area will be less and the wear will be lower. Furthermore, the design of the device for tensioning core tubes in accordance with the invention allows the core cross-section of the arbor to be expanded, increasing its strength.

In one preferred embodiment of the invention the cross-section of the floor of each circumferential groove in the arbor is convex. The convexity makes the arbor thicker, which also contributes to its strength.

In another preferred embodiment of the invention the longitudinal cross-section of the floors of the circumferential grooves in the arbor is concave. The concavity prevents the fatigue notching that can occur at sharp-edged transitions in the grooves and increases mating precision or allows compensation of slight manufacturing errors.

Since the supports in the hemispherical depressions in the tensioning segments always support the segments at the same point, even while the arbor is turning, the segments will not tilt as easily as in the known device, wherein the supports can also become displaced in relation to the tensioning segments when the arbor turns. Still, the tensioning elements will continue to rock against the arbor to the same extent as a result of their ball-bearing type of coupling with the supports.

Some preferred embodiments of the invention will now be described with reference to the accompanying drawings, wherein

DETAILED DESCRIPTION OF THE PREFERRED EMBODIMENTS

Figure 1:
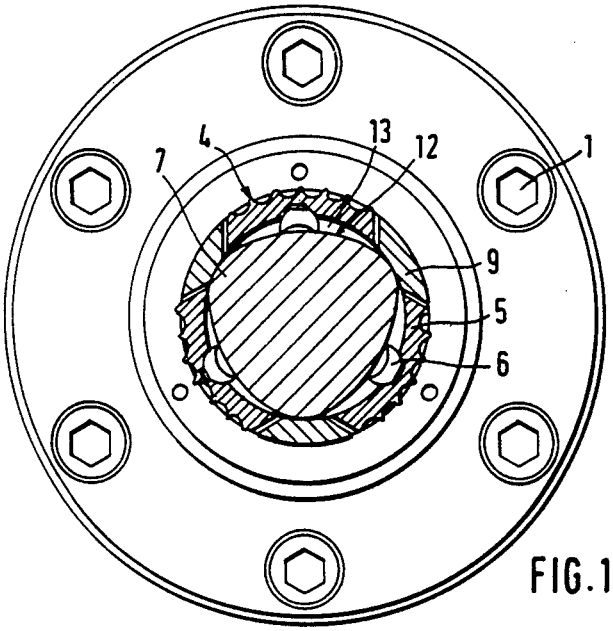
FIG. 1 is a transverse section through a device for tensioning core tubes.
Figure 2:
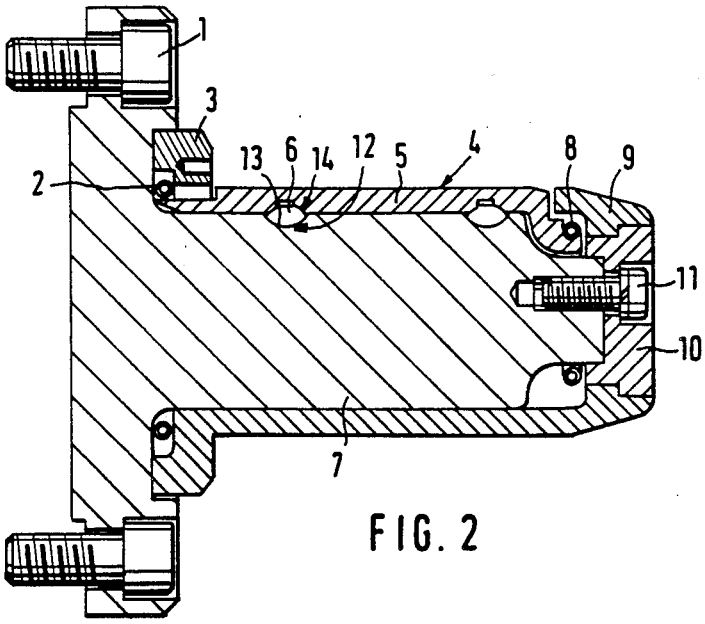
FIG. 2 is a longitudinal section through the tensioning device.

A device for tensioning core tubes consists as illustrated in FIGS. 1 and 2 of flanging screws 1, of an annular spring 2, of a frontal ring 3, of tensioning segments 5 in the shape of segments of a hollow cylinder with serrated or corrugated outer surfaces 4, of supports 6, of another annular spring 8, of a cage 9, and of a cover plate 10 that is fastened to an arbor 7 by means of a screw 11 and that secures the axial position of the other parts, which are slid over the arbor.

Figure 3:
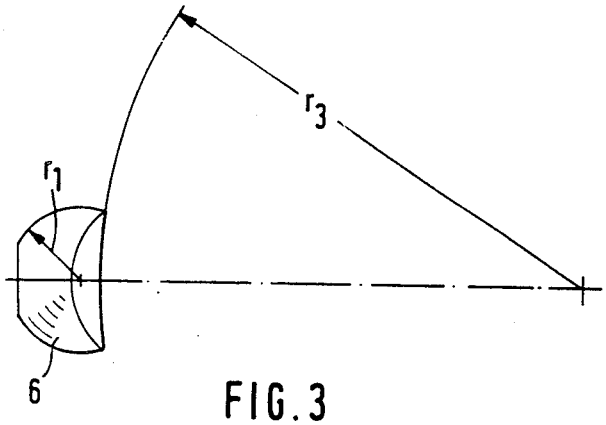
FIG. 3 is a transverse section through a support.
Figure 4:
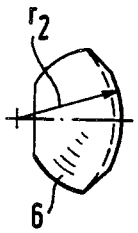
FIG. 4 is a larger-scale transverse section through a support.

The floor 12 of the circumferential grooves 13 in the arbor 7 illustrated in FIG. 2 is concave. The surface of each support 6 that faces arbor 7 is accordingly shaped like the arc of a circle with a radius $r_2$ (FIG. 4). The circumferential grooves 13 are convex from the aspect of the cross-section of FIG. 1. The residual core cross-section of the arbor 7 is indicated in FIG. 1 by the hatched area. The surface of support 6 that faces arbor 7 accordingly matches the convexity of the floor 12 of circumferential groove 13 from the aspect of the cross-section of FIG. 1 with a radius $r_3$ (FIG. 3). The supports 6 in this embodiment contact the floors 12 of the circumferential grooves 13 in arbor 7 over an area, as will be evident from FIGS. 1 and 2.

Tensioning segments 5 have hemispherical depressions 14 that are also fully contacted by the spherical surfaces of supports 6, which have a radius $r_1$. Thus, supports 6 and tensioning segments 5 constitute a ball-bearing type of articulation that allows tensioning segments 5 to rock to a certain extent around the axis of arbor 7.

The tensioning device is assembled by placing tensioning segments 5 in circumferential grooves 13 with supports 6 in between or the depressions 14 in tensioning segments 5 over arbor 7 and securing them radially with annular springs 2 and 8. Cage 9 is then slid over arbor 7 and attached to it with cover plate 10 and screw 11.

It is understood that the specification and examples are illustrative but not limitative of the present invention and that other embodiments within the spirit and scope of the invention will suggest themselves to those skilled in the art.

I claim:

1. In an apparatus for tensioning core tubes, such as for webs of paper or similar materials, and comprising an arbor having circumferential grooves on the surface thereof, a cage disposed on the arbor, a plurality of tensioning segments in the shape of arcs of a hollow cylinder displaceable radially inside the cage and distributed around the arbor, and supports positioned between the arbor and the tensioning segments in the circumferential grooves on the surface of the arbor, wherein the cross section of the arbor is equilateral polygon-like with arcuate sides in the vicinity of the grooves, the improvement wherein each support has one side facing an inner surface of one tensioning segment, wherein the one side of the support is spherical, wherein each circumferential groove has a floor, wherein the inner surface of the tensioning segment has a hemispherical depression into which the spherical one side of the support is inserted, and wherein each support has another side that faces the arbor and has a contact surface that matches the cross-section of the floor of the groove.

2. An apparatus according to claim 1, wherein the cross-section of the floor of each circumferential groove in the arbor taken in a plane transverse to the arbor is convex.

3. An apparatus according to claim 1, wherein the cross-section of the floor of each circumferential groove in the arbor taken in a plane longitudinally of the arbor is concave.

* * * * *